United States Patent [19]

Brinkman

[11] 3,994,272

[45] Nov. 30, 1976

[54] INJECTOR

[75] Inventor: Willem Brinkman, Velp, Netherlands

[73] Assignee: Holec, N.V., Hengelo, Netherlands

[22] Filed: Mar. 19, 1974

[21] Appl. No.: 452,549

[30] Foreign Application Priority Data

Nov. 16, 1973 Netherlands ..... 7315769

[52] U.S. Cl. ..... 123/139 E; 417/410; 310/29; 220/309; 92/13; 92/13.5; 123/32 EA

[51] Int. Cl.² ..... F02B 3/00; F02M 39/00

[58] Field of Search ..... 123/139 E, 32 AC; 417/410, 411, 412, 415; 310/29, 36; 220/309; 92/130 R, 13, 13.1, 13.5, 13.51, 13.7, 13.71

[56] References Cited

UNITED STATES PATENTS

| | | | |
|---|---|---|---|
| 1,534,829 | 4/1925 | Behnke | 123/139 E |
| 1,850,926 | 3/1932 | Feyens | 92/13 |
| 2,148,112 | 2/1939 | Dillstrom | 92/13.1 |
| 2,836,110 | 5/1958 | Frantz | 417/410 |
| 2,865,357 | 12/1958 | Muellor | 92/13.1 |
| 3,009,628 | 11/1961 | Kolfertz | 417/410 |
| 3,784,334 | 1/1974 | Hilgert | 417/410 |

FOREIGN PATENTS OR APPLICATIONS

| | | | |
|---|---|---|---|
| 936,842 | 7/1948 | France | 92/13.1 |
| 397,493 | 8/1933 | United Kingdom | 123/139 E |

*Primary Examiner*—Charles J. Myhre
*Assistant Examiner*—Ronald B. Cox
*Attorney, Agent, or Firm*—Snyder, Brown and Ramik

[57] ABSTRACT

An injector for delivering fuel to a combustion engine in which the pump chamber of each fuel pump has a volume adjustable by control means, is provided with a displacer body which is connected to an armature of an electromagnet. The stroke of the displacer body is limited by an adjustable stop and should be influenced as less as possible by wear due to stopping a considerable mass of the armature every time. In order to expose the injector less to wear the displacer body is coupled with the armature through an elastic coupling.

14 Claims, 8 Drawing Figures

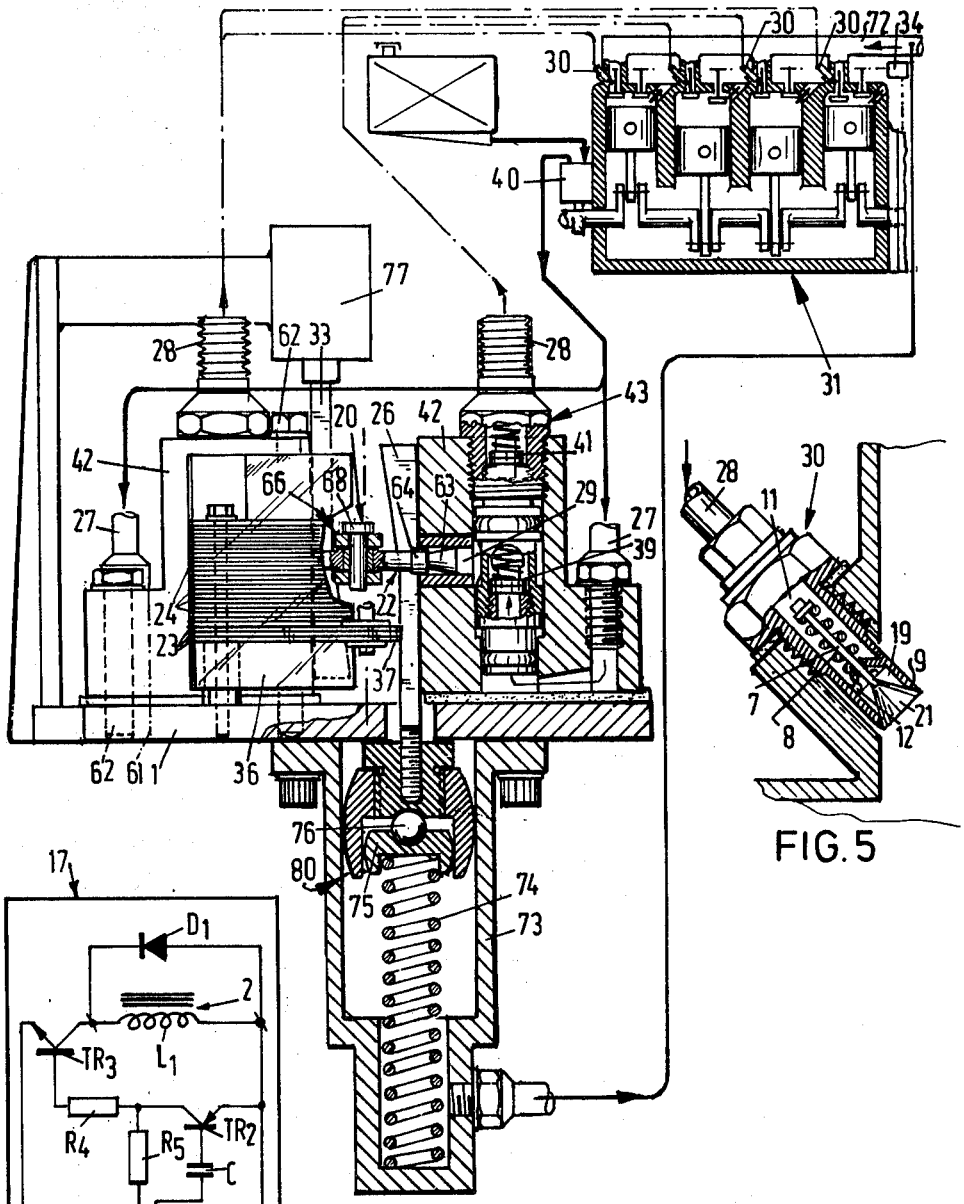
FIG. 2
FIG. 5
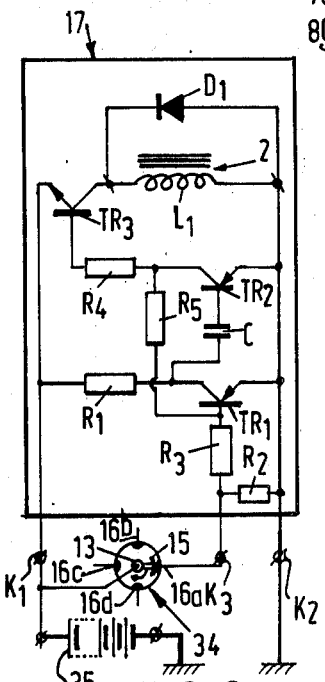
FIG. 6

INJECTOR

The invention relates to an injector for delivering fuel to a combustion engine, in which the pump chamber of each fuel pump having a displacement volume adjustable by control-means communicates via an inlet valve with a fuel supply and via an outlet valve with a fuel outlet to be connected with the fuel inlet of the combustion engine and is limited by at least one displacer body, which is coupled with at least one armature of at least one electro-magnet and which has a stroke limited by at least one stop adjustable by said control-means.

Such an injector is known. The displacer body is rigidly connected with the armature so that at each pump stroke a considerable mass abutts against the stop, which involves rapid wear of the stop. The pump output is dependent upon this wear.

The invention has for its object to provide an injector which is less exposed to wear. For this purpose the injector of the kind set forth is characterized in accordance with the invention in that the displacer body is coupled with the armature through an elastic coupling. With this injector the mass of the displacer body is not spring-controlled so that it accurately covers the path determined by the stop and pumps up the adjusted displacement volume, whereas the considerable bulk of the armature is, on the contrary, spring-controlled so that the wear of stop surfaces is reduced.

When one end of the armature is adapted to turn about a pivotal shaft and the other end of the armature is coupled with the displacer body, a simple, elastic coupling is obtained, when this elastic coupling comprises a pin, a sleeve and an interposed, elastic ring. This ring may be made of a superpolyamide.

The invention furthermore relates to an injector for giving off fuel to at least two fuel inlets of a combustion engine, in which at least two fuel pumps each have a pump chamber with a displacement volume adjustable by control-means, said chambers communicating via an inlet valve with a fuel inlet and via an outlet valve with a fuel outlet to be connected with a fuel inlet of the combustion engine and being each limited by at least one displacer body. The invention has for its object to improve said injector so that the outputs of all fuel pumps are accurately the same. This is achieved by arranging the pump housings of the two fuel pumps in the axial direction at a distance from each and by rigidly connecting them with one another by connecting means, whilst the two displacer bodies of the two fuel pumps are coupled with each other and by means of a coupling with at least one armature of at least one electromagnet, the pump housings having arranged between them the control-means limiting the stroke of the displacer bodies. With this injector all surfaces affecting the length of the stroke of the displacer bodies are located in close proximity of one another so that discrepancies between the displacement volumes of the fuel pumps due to mounting tolerances and/or to the deformation of parts are negligible.

The armature is preferably adapted to pivot between two alternately energized electro-magnets arranged at the side of the pump housings.

The advantages of the invention are particularly important when the pump housings of at least four fuel pumps are arranged pairwise in an axial direction at a distance from and opposite one another and when two housing blocks are formed by pump housings mounted one to the other, whilst common control-means are arranged between the housing blocks.

If the control-means are formed by at least one or two wedges, the space occupied by the control-means between each pair of pump housings is slight. When the wedges are not actuated, they remain in the set position. On the other hand the wedges can be displaced by a small force in the direction in which the pump stroke increases, because the coupling member then moves down the slope. This has the advantage that already with a slight force of the feeler adjusting the wedge under the control of the presssure in the air inlet manifold of the combustion engine the acceleration of the combustion engine is initated, the mixture sucked into the combustion engine being then rich in fuel.

In order to enhance the sensitivity of the control-means they are preferably driven by a barrel-shaped piston of a cylinder to be connected with the air inlet manifold of a combustion engine and/or they are driven by a piston of a cylinder to be connected with the air inlet manifold of a combustion engine, which piston is subjected to the action of a reset spring via a central ball. With this injector the force required for displacing the piston is small because scraping of the piston is avoided.

The invention furthermore provides a simplification of the construction of an injector for delivering fuel to at least one fuel inlet of a combustion engine, in which the pump chamber of at least one fuel pump having a displacement volume adjustable by control-means communicates via an inlet valve with a fuel supply and via an outlet valve with a fuel outlet to be connected with the fuel inlet of the combustion engine and is limited by at least one displacer body, by arranging the valves in a separate valve housing adapted to be screwed into the pump housing and communicating with the pump chamber. Mounting and maintenance of the fuel pumps, in particular, are facilitated in this way. In accordance with a further development of the invention the manufacture of said valve housing and sealing of the various fitting surfaces are facilitated by forming the valve housing from three portions to be interconnected, that is to say, an inlet portion, an outlet portion and an intermediate portion.

If the inlet and/or outlet valves comprise a valve body of a synthetic resin and a metallic supporting ring for the vavle spring embedded in said body, the comparatively soft material of the valve body ensures a perfect seal between the valve body and the seat, whilst the metallic supporting ring prevents the valve spring from penetrating into the soft material of the valve body. This valve may be particularly small.

The invention provides a rugged injector with vigourous driving of each displacer body since the armature is pivotally connected with at least one magnetic plate of the electro-magnet. In this injector the armature is secured extremely rigidly to the electro-magnet. A simple embodiment is obtained when the armature is pivotally connected to the ear of at least one magnet plate of the electro-magnet. The magnet plate can be flanged thereto by one ear.

The electro-magnet can be rigidly secured to a frame of the injector by means of bolts engaging the magnet plate.

The invention provides furthermore a combustion engine provided with an injector in accordance with the invention.

The aforesaid and further features of the invention will be described more fully hereinafter with reference to the drawing. In the drawing:

FIG. 2 is a sectional view taken on the line II-II in FIG. 1 with a schematically shown connection with a combustion engine.

FIG. 5 shows, on an enlarged scale, an atomizer,

FIG. 6 is a circuit diagram of an electronic circuitry,

Figure 1:
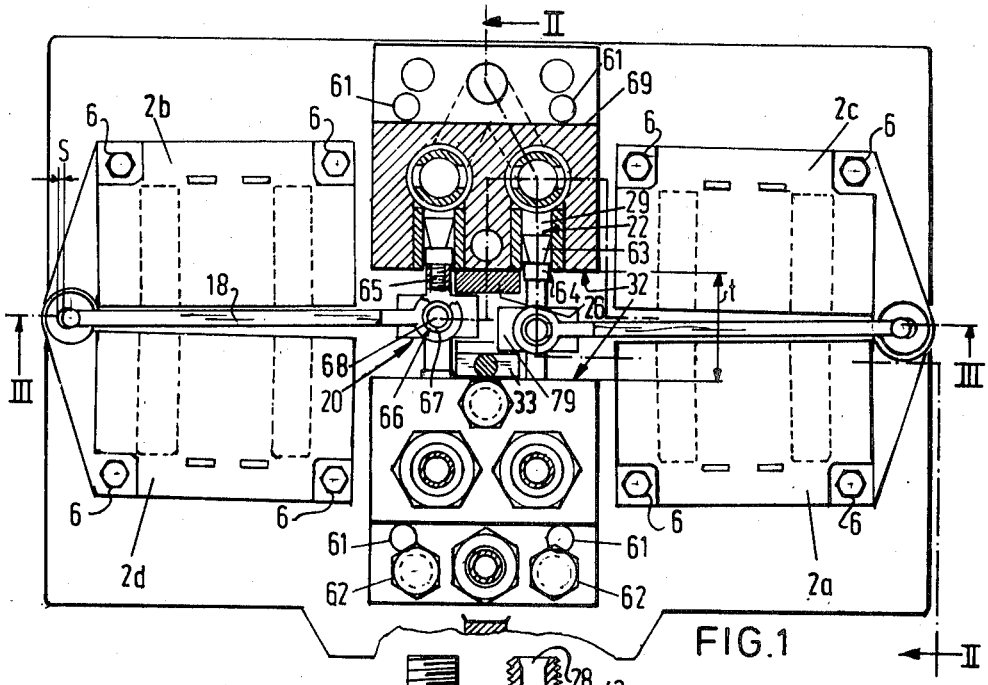
FIG. 1 is a partially broken-away plan view of a preferred embodiment of an injector in accordance with the invention.
Figure 3:
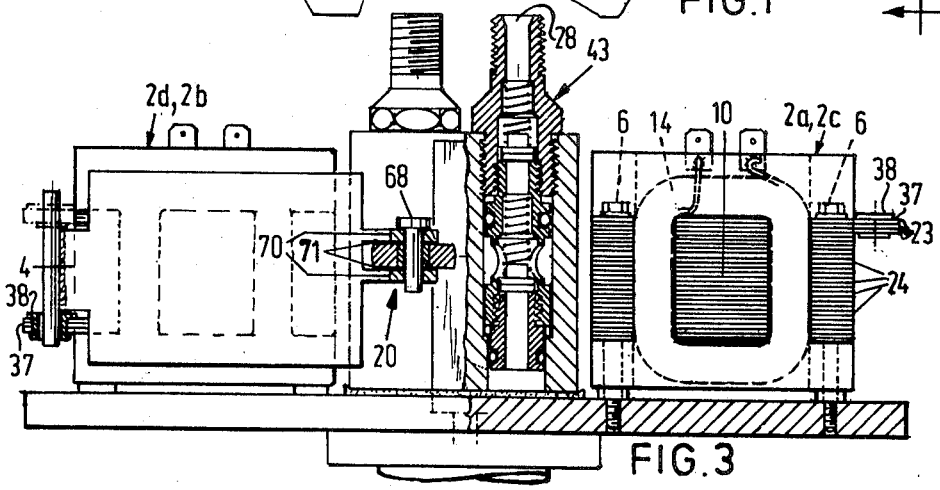
FIG. 3 is a sectional view taken on the line III—III in FIG. 1.
Figure 7:
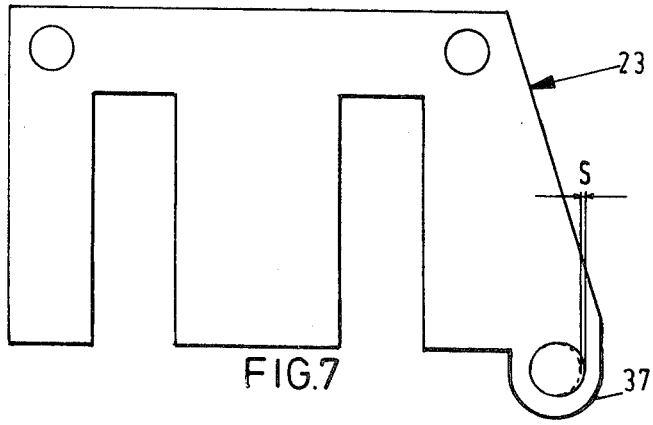
FIG. 7 is a plan view of a magnet plate with an ear.

Two pairs of electro-magnets 2 are secured by means of bolts 6 and sleeves 25 surrounding said bolts to a mounting plate 1, which constitutes the frame of the injector. Each of the electro-magnets 2 comprises a core 10 of a stack of magnet plates 23 and 24 and an energizing coil 14 surrounding said core 10. The bolts 6 engage the magnet plates 23 and 24. Each electro-magnet 2 is embedded in a block of a synthetic resin 36. Between each pair of alternately energized magnets 2 is pivotally arranged a sheetl-like armature 18. Each armature 18 is pivotally connected by one end 4 with projecting ears 37 of magnet plates 23 of each one of a pair of electro-magnets 2 by means of an elastic coupling formed by a ring 38 of elastic material, for example, a superpolyamide. Because the ring 38 is engaged in a recess with a clearance S of, for example, 0.2 mm, the armature 18 is slightly displaceable in its direction of length. At the free end 5 each armature 18 holds a cross-like coupling member 20, with which two displacer bodies 22 of two fuel pumps 32 are connected. The stroke of the displacer bodies is determined by adjustable control-means arranged on each side of the coupling members 20 and formed by two wedges 26 and 33. Each pump 32 comprises a pump chamber 29 having a fuel inlet 27 and a fuel outlet duct 28, each of which lead to an atomizer 30 of a combustion engine 31. The inlet valve 39 and the outlet valve 41 are arranged in a separate valve housing 43, to be screwed into the pump housing 42 and formed by three portions to be interconnected, to wit: an inlet portion 44, an outlet portion 45 and an intermediate portion 46. The inlet portion 44 having an inlet seat 48 and adapted to be connected with a fuel supply pump 40 is screwed into the intermediate portion 46 and has an annular groove 49 for accommodating a sealing member in order to obtain a seal with respect to the pump housing 42. The intermediate portion 46 has an external, annular groove 51 and two channels 52, through which the space 53 of the valve housing 43 located between the inlet valve 39 and the outlet valve 41 communicates with the pump chamber 29. The intermediate portion 46 having an outlet seat 54 is screwed into the outlet portion 45 and exhibits an annular groove 55 receiving a sealing member 56. The outlet portion 45 is screwed into the pump housing 42 with the interposition of a sealing ring 47. The inlet valve 39 and the outlet valve 41 comprise each a valve body 78 of polytetra-fluoroethylene and a copper supporting ring 57 for a valve spring 58.

Into each pump housing 42 is pressed a hard-steel cylinder 59 with heavy compression fit. Afterwards the front face 60 of the cylinder 59 and of the pump housing 42 is ground to flatness. The pump housings 42 are disposed pairwise coaxially opposite one another and are held at a distance *t* from one another by means of connecting means. These connecting means are formed by fitting pins 61 and bolts 62 securing the pump housings 42 rigidly to the mounting plate 1. By means of the fitting pins 61 the front faces 60 are held in accurate parallel relationship.

The displacer bodies 22 are each made of a synthetic resin, preferably a superpolyamide and comprise each a cup-shaped piston 63, a guide collar 64 engaging the pump chamber 29 and a screw member 65, which is screwed with the interposition of glue into a hard-steel coupling member 20.

The injector shown in FIG. 1 comprises two cross-like coupling members 20 and the displacer bodies 22 of each pair of fuel pumps 32 are coupled with each other by means of one coupling member 20. Each coupling member 20 is coupled by means of an elastic coupling 66 with an armature 18. This elastic coupling 66 comprises an elastic ring 67 accommodated in the coupling member 20 and surrounding a pin 68 of the armature 18 and preferably made of a superpolyamide.

The displacement volume of each fuel pump 32 is determined by the stroke of the coupling member 20, which is adapted to reciprocate with an arm 79 between the wedges 26 and 33. In order to ensure an accurate adjustment of said stroke both the coupling member 20 and the wedges 26, 33 are made of hard steel, whilst the wedges are in contact with the hard-steel cylinders 59. In order to avoid excessive wear of said parts, the comparatively small over-all bulk of the coupling member 20 and of the two displacer bodies 22 connected herewith is separated from the comparatively large bulk of the armature 18 by the elastic coupling 66. At each stroke the coupling member 20 strikes a hard stop, whilst the bulk of the armature 18 moves on over a small distance and is controlled by spring force.

Two blocks of housing 69 comprise each two joined pump housings 42, between which wedges 26 and 33 are arranged, which serve as common control-means for each of the pumps 32. The distance *t* and the coupling members 20 are small so that inaccurracies in pump outputs due to deformation of coupling members and/or due to mounting tolerances are slight.

a fourth arm 70 is provided with guide surfaces 71, which co-operate with the armature 18 in order to avoid tilting of the coupling member 20.

Each atomizer 30 comprises a needle 7, a conical end 21 of which is sealingly drawn to the seat 9 by a strong spring 8. Said end 21 is urged away from the seat 9 against the action of the spring 8 at a high pressure of fuel in a chamber 11 communicating with the fuel duct 28 and through a chamber 19 communicating herewith through a perforated collar 12 (see FIG. 5).

Each electro-magnet 2 is controlled by a circuitry 17 shown schematically in FIG. 6. The transistors $TR_1$ and $TR_2$ together with the associated resistors $R_1$, $R_2$, $R_3$, $R_4$ and $R_5$ and the capacitor C constitute a monostable multivibrator. The resistor $R_1$ and the capacitor C determine the time constant. The collector output of the transistor $TR_2$ constitutes through the resistor $R_4$ the input of the transistor $TR_3$, which serves as an amplifier for the current to be passed through the coil $L_1$ of the electro-magnet 2. Across the coil $L_1$ is connected a quenching diode $D_1$. To the imput terminals $K_1$ and $K_2$ is connected a supply source 35, whereas the input $K_3$ serves for the supply of a control-pulse which may originate from a pulse generator 34 coupled with the engine 31. The pulse generator 34 may be coupled with a cam shaft 13 of the combustion engine 31 and comprises a rotatable contact 15, which alternately engages one of the four contacts 16*a*, 16*b*, 16*c* and 16*d* for energizing sequentially the electro-magnets 2*a*, 2*b*, 2*c* and 2*d*. Each of said four contacts 16*a*, 16*b*, 16*c* and 16*d* is connected to an input terminal $K_3$ of the circuitry 17. In this way an atomizer 30 injects the fuel required for each combustion cylinder at the required instant in each cycle of the combustion engine 31. The order of succession of energization of the electro-magnets 2*a* to 2*d* is chosen so that in each cycle each of the wedges 26 and 33 is momentarily released from a coupling member 20 so that they can be displaced each with a slight force.

FIG. 2 illustrates the drive of the wedge 26 by means of a barrel-shaped piston 80 of a cylinder 73 communicating with the air inlet manifold 72 of the combustion engine 31.

A reset spring 74 engages centrally the piston 80 via a cup spring 75 and a ball 76. Frictional resistance due to scraping of the piston 80 is thus prevented from delaying the adjustment of the wedge 26. The other wedge 33 is adjusted independently of the wedge 26 by the action of other factors, for example, atmospheric pressure or engine temperature by means of a control-member 77.

Figure 8:
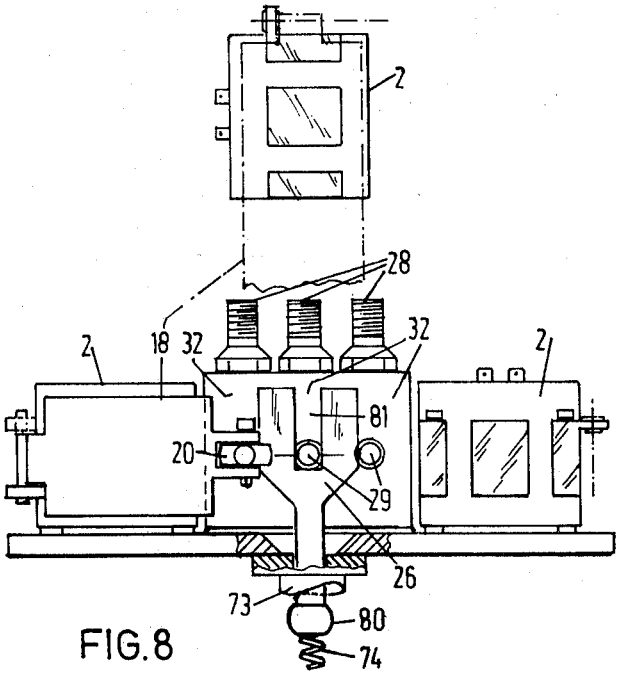
FIG. 8 shows schematically the disposition of various parts of an injector for use in a six-cylinder combustion engine.
Figure 4:
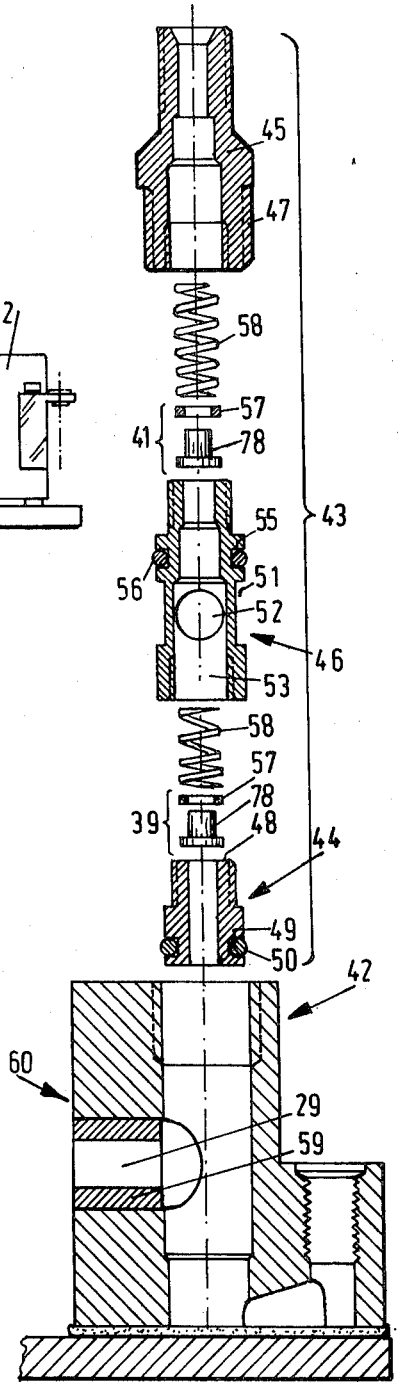
FIG. 4 is an exploded view of a detail of FIG. 3.

FIG. 8 illustrates the arrangement of three pairs of fuel pumps 32 with three coupling members 20, each of which is driven by the armature 18 of a pair of electro-magnets 2. A wedge 26 has a recess 81 for passing the central coupling member 20 and is adjusted by the piston 80 of a cylinder 73.

What is claimed is:

1. An injector for deliverng fuel to at least one inlet of a combustion engine, comprising in combination:

a fuel pump having a pump chamber and a displacer body cooperable therewith to vary the volume of said chamber;

an inlet valve connected with said chamber of admitting fuel into the chamber and an outlet valve for allowing fuel to be discharged from the chamber;

drive means for moving said displacer body back and forth alternately to induct fuel into and to dischareg fuel from said chamber, said drive means including an electromagnet, means for periodically energizing said electromagnet, and an armature associated with said electromagnet;

control means for variably delineating the stroke of the back and forth movement of said displacer body, said control means including a movable rigid stop disposed in the path of movement of said displacer body to intercept said displacer body accurately to control movement thereof; and coupling means elastically coupling said displacer body to said armature for allowing slight continuation in movement of said armature after striking of said displacer body against said stop.

2. An injector as claimed in claim 1 including a first pin pivotally mounting an end of the armature, said coupling means connecting the other end of the armature to the displacer body and comprising a second pin and an elastic ring surrounding said second pin.

3. An injector as claimed in claim 2, characterized in that said ring is made of a superpolyamide.

4. In a fuel injector including a pair of electromagnets disposed in spaced, opposed relation defining a relatively narrow gap therebetween, an armature within said gap and having an end portion projecting therebeyond, means for alternately energizing said electromagnets to shuttle said armature back and forth within said gap, a displacer member carried by said end portion of the armature for reciprocation thereby back and forth along an axis transverse to said armature, and a pump body having a pump chamber into which a portion of said displacer member projects, the combination of:

a pair of rigid stop members disposed in path of movement of said displacer member to intercept said displacer member as it reciprocates back and forth along said axis whereby positively and accurately to delineate the stroke of said displacer member, at least one of said stop members being adjustable to vary said stroke of the displacer member, and means elastically coupling said displacer member to said armature for allowing slight continuation in movement of said armature after each striking of said displacer member against a stop member.

5. In a fuel injector including a pair of electromagnets disposed in spaced, opposed relation defining a relatively narrow gap therebetween, an armature within said gap and having an end portion projecting therebeyond, means for alternately energizing said electromagnets to shuttle said armature back and forth with said gap, a pair of pump bodies, one on either side of said end portion of the armature and each having a pump chamber therein, a displacer member carried by said end portion of the armature and bridging between said pump bodies and having opposite end portions cooperative with the pump chambers of said pump bodies such that as the displacer member is reciprocated back and forth by said armature fuel is inducted into one chamber while fuel is discharged from the other chamber and vice versa, a pair of rigid stop means for intercepting said displacer member in its back and forth movements positively and accurately to delineate each stroke of said displacer member, at least one of said stop means being adjustable to vary the strokes of said displacer member, and means elastically coupling said displacer member to said armature for allowing slight continuation in movement of said armature at each end stroke position of said displacer member.

6. In a fuel injector as defined in claim 4 including pivot means pivotally mounting that end of said armature opposite said displacer member whereby said armature flaps back and forth.

7. In a fuel injector as defined in claim 6 wherein said pivot means allows sufficient longitudinal movement of said armature whereby said displacer member is permitted to reciprocate rectilinearly.

8. In a fuel injector as defined in claim 4 wherein each electromagnet comprises an E-shaped frame and a winding on the central leg presented by said frame, the electromagnets being oriented with respect to each other so that the legs of the two frames are in spaced opposition.

9. In a fuel injector as defined in claim 8 including a mounting plate to which said electromagnets and said pump body are attached, the electromagnets being secured to said mounting plate by means of bolts passing through said frames.

10. In a fuel injector as defined in claim 5 including pivot means pivotally mounting that end of said armature opposite said displacer member whereby said armature flaps back and forth.

11. In a fuel injector as defined in claim 10 wherein said pivot means allows sufficient longitudinal movement of said armature whereby said displacer member is permitted to reciprocate rectilinearly.

12. In a fuel injector as defined in claim 5 wherein each electromagnet comprises an E-shaped frame and a winding on the central leg presented by said frame, the electromagnets being oriented with respect to each other so that the legs of the two frames are spaced opposition.

13. In a fuel injector as defined in claim 12 including a mounting plate to which said electromagnets and said pump body are attached, the electromagnets being secured to said mounting plate by means of bolts passing through said frames.

14. A fuel injector assembly for internal combustion engines comprising, in combination:

a base member having a pair of pump bodies and two pairs of electromagnets attached thereto, said pump bodies being disposed in spaced apart relation and each having a pair of bores therein with corresponding bores of the two pump bodes being aligned, and each pair of electromagnets being disposed in spaced relation to define a corridor therebetween leading toward the space between said pump bodies, one pair of electromagnets being disposed to one side of said pump bodies and the other pair of electromagnets being disposed to the opposite side of said pump bodies;

an armature associated with each pair of electromagnets, there being one armature pivotally mounted at one end thereof to said base member adjacent that end of one corridor remote from said pump bodies and extending through said one corridor to terminate in a free end portion between said pump bodies, and a second armature pivotally mounted at one end to said base member adjacent that end of the other corridor remote from said pump bodies and extending through said other corridor to terminate in a free end portion between said pump bodies;

a first displacer member pivotally connected to said free end of said one armature and having opposite end portions received in one pair of aligned bores in said pump bodies;

a second displacer member pivotally connected to said free end of said second armature and having opposite end portions received in the other pair of aligned bores in said pump bodies;

means for alternately energizing the electromagnets of each pair thereof whereby said armatures flap back and forth to reciprocate said displacer members;

a pair of stop members, one disposed adjacent each pump body and each displacer member including a portion which strikes against said stop members whereby accurately to delineate the strokes of said displacer members, at least one of said stop members being wedge shaped and including means for axially shifting said one stop member whereby to alter the strokes of said displacer members, and means elastically coupling each displacer member to its respective armature for allowing slight continuation in movement of each armature after each striking of its associated displacer member against said stop members.

* * * * *